US006176562B1

(12) United States Patent
Hart

(10) Patent No.: US 6,176,562 B1
(45) Date of Patent: Jan. 23, 2001

(54) RETAINING ASSEMBLY FOR A BEVERAGE SERVER ASSEMBLY

(75) Inventor: Burton L. Hart, Auburn, IL (US)

(73) Assignee: Bunn-O-Matic Corporation, Springfield, IL (US)

( * ) Notice: Under 35 U.S.C. 154(b), the term of this patent shall be extended for 0 days.

(21) Appl. No.: 09/338,184

(22) Filed: Jun. 22, 1999

(51) Int. Cl.[7] ..... A47B 91/08
(52) U.S. Cl. ..... 312/351.1; 248/678; 248/680
(58) Field of Search ..... 99/280; 248/673, 248/676, 677, 678, 680, 501, 502; 312/351.1

(56) References Cited

U.S. PATENT DOCUMENTS

Re. 25,663 * 10/1964 Bunn ..... 99/280 X
4,621,571 * 11/1986 Roberts ..... 99/280 X
4,669,695 6/1987 Chou .
4,773,313 9/1988 Anson .
5,067,525 11/1991 Whipple .
5,624,098 * 4/1997 McDowell ..... 248/673 X
5,907,993 * 6/1999 Van Camp et al. ..... 99/280

* cited by examiner

*Primary Examiner*—Anthony D. Barfield
*Assistant Examiner*—Michael J. Fisher
(74) *Attorney, Agent, or Firm*—Trexler, Bushnell, Giangiorgi & Blackstone, Ltd.

(57) ABSTRACT

A beverage server assembly includes a base, a housing for holding a beverage which is positioned on the base, and a contact member between the base and the housing. The contact member is fixed to the base and is in electrical connection with the housing. The base is supported above a surface on which the beverage server assembly is positioned, such as a countertop, at a predetermined height by legs. Each leg has a foot attached thereto. Each rear leg of the base is secured to the surface by a bracket to prevent a customer from tipping the beverage server assembly towards the surface. The housing is releasably coupled to the contact member by a cleat and bracket assembly which retains the beverage server on the server power station should a customer attempt to tip the top end of the beverage server toward the front of the server power station and thus toward a surface on which the beverage server assembly is positioned when the beverage level becomes low in an attempt to obtain further beverage from the beverage server.

10 Claims, 3 Drawing Sheets

RETAINING ASSEMBLY FOR A BEVERAGE SERVER ASSEMBLY

BACKGROUND OF THE INVENTION

This invention is generally directed to a novel retaining assembly for a beverage server assembly. Prior art beverage server assemblies have a beverage server which holds beverages therein and which is positioned on top of a server power station. In one aspect of the present invention, an assembly is provided for coupling the beverage server and the server power station together to retain the beverage server on the server power station should a customer attempt to tip the top end of the beverage server toward the front of the server power station and thus toward a surface on which the beverage server assembly is positioned, such as a countertop, when the beverage level becomes low in an attempt to obtain further beverage from the beverage server. In another aspect of the present invention, a structure is provided for coupling the server power station with the surface to prevent the possibility of a customer tipping the top end of the beverage server assembly toward the surface when the beverage level becomes low in an attempt to obtain further beverage from the beverage server. Other features and advantages of the present invention will become apparent upon a reading of the attached specification in combination with a study of the drawings.

SUMMARY OF THE INVENTION

Briefly, and in accordance with the foregoing, the present invention discloses a novel retaining assembly for a beverage server assembly. The beverage server assembly includes a server power station, a beverage server positioned on the server power station, and a contact member between the server power station and the beverage server. The beverage server has a reservoir therein for holding a beverage, such as coffee. The contact member is fixed to the server power station and is in electrical connection with the beverage server.

The server power station is supported above a surface on which the beverage server assembly is positioned, such as a countertop, at a predetermined height by legs. Each leg has a foot removably attached thereto. Each rear leg of the base is secured to the surface by a bracket to prevent a customer from tipping the beverage server assembly towards the surface.

The beverage server is removably coupled to the contact member by a cleat and bracket assembly which retains the beverage server on the server power station should a customer attempt to tip a top end of the beverage server toward the front of the server power station and thus towards the surface. A protrusion is attached to the rear wall of the beverage server. An L-shaped member is attached to the contact member, and thus the server power station, and extends upwardly therefrom and engages and overlaps the protrusion to retain the beverage server on the server power station.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
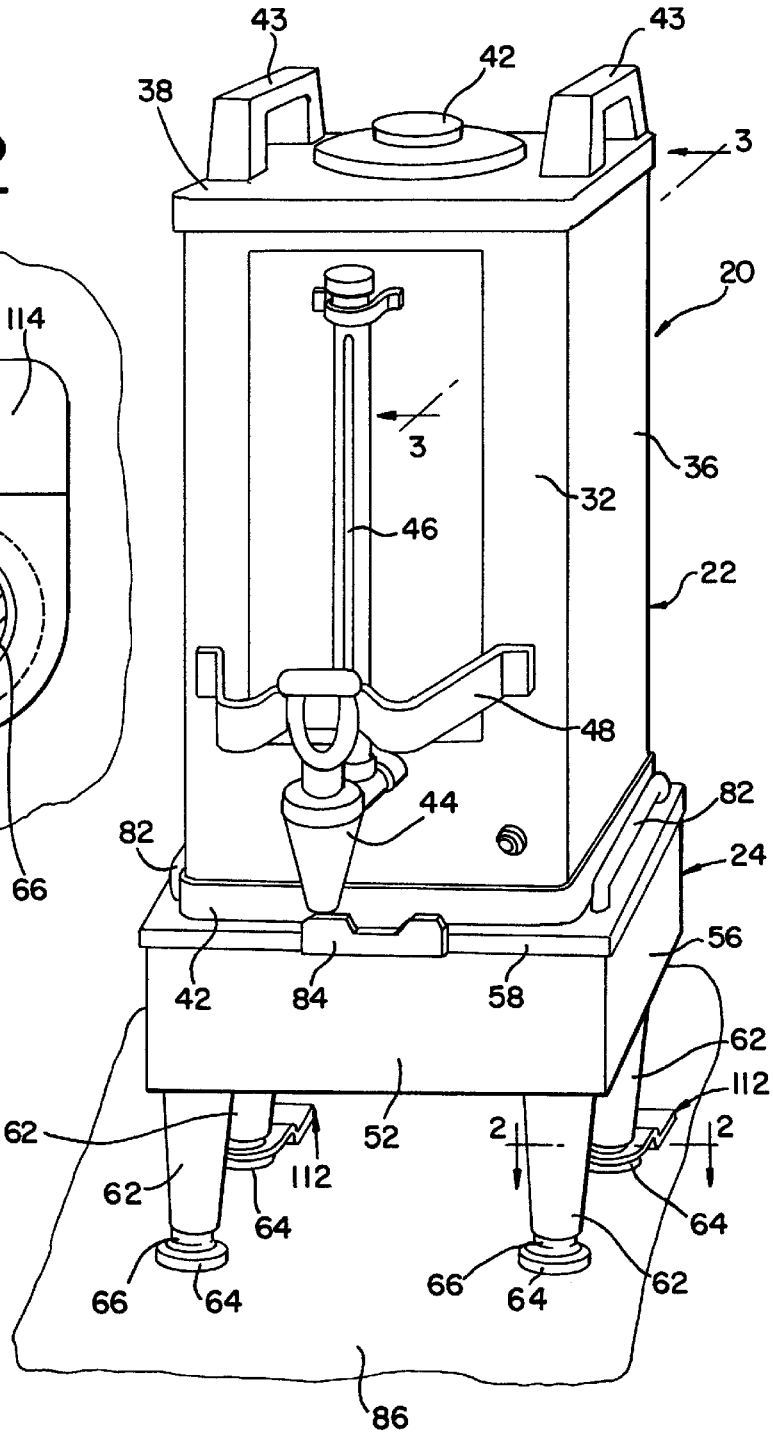
FIG. 1 is a perspective view of a beverage server assembly which incorporates the features of the invention.
Figure 2:
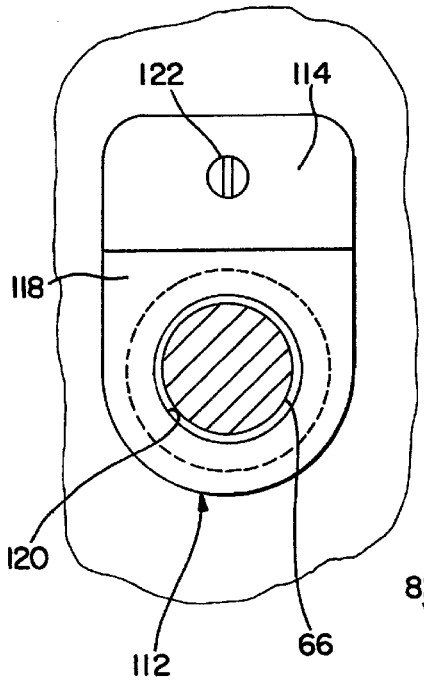
FIG. 2 is a cross-sectional view along line 2—2 of FIG. 1.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The present invention provides a novel retaining assembly for a beverage server assembly 20. The beverage server assembly 20 includes a beverage server 22 which sits on top of a base or server power station 24 and is connected to the server power station 24 by a server power contact member 26.

The beverage server 22 includes a housing 28 having a reservoir 30 therein for holding a quantity of a desired beverage. The housing 28 includes a front wall 32, a rear wall 34, opposed side walls 36, 38, a top 40 and a bottom 41. A lid 42 and a pair of handles 43 on either side of the lid 42 are attached to the top 40 of the housing 28. A faucet 44 for dispensing beverage from the reservoir 30 is positioned on the front wall 32 of the housing 28 and is connected to the reservoir 30 therewithin. A sight gauge 46 is also coupled to the faucet 44 for viewing the approximate level of the beverage within the reservoir 30. A faucet guard 48, which also serves as a carrying support, is attached to the front wall 32 of the housing 28. A heating assembly and control circuit 50 are provided within the housing 28 beneath the reservoir 30 for providing thermostatically controlled heat to the beverage retained in the reservoir 30. The control circuit supplies power to the heating assembly from the server power station 24. Specifics of the heating assembly and control circuit 50 is disclosed in co-pending application Ser. No. 09/057,463 which is commonly owned by the assignee herein and which disclosure is herein incorporated by reference.

The server power station 24 is unheated and includes a front wall 52, a rear wall 54, opposed side walls 56, a top 58 upon which the housing 28 is positioned, and a bottom wall 60. A leg 62 is securely attached proximate to each corner of the bottom wall 60 of the server power station 24 by suitable means, such as by welding. Each leg 62 has a foot 64 securely mounted thereon by suitable means, such as a threaded arrangement between the respective leg 62 and foot 64. Each foot 64 has a reduced diameter portion 66 proximate to the respective leg 62. The heating assembly and control circuit 50 within the housing 28 is coupled to and receives power from the server power station 24 by electrical connection through the server power contact member 26.

The server power contact member 26 includes a front wall 68, a rear wall 70, opposed side walls 72, a top wall 74, and a bottom wall 75. The server power contact member 26 is mechanically mounted to the rear wall 28 of the server power station 24 by the provision of bolts 78 through the front wall 68 of the server power contact member 26 and through the rear wall 54 of the server power station 24 such that the front wall 68 of the server power contact member 26 is parallel to the rear wall 34 of the server power station 24. The server power contact member 26 extends upwardly from the top 58 of the server power station 24. Other suitable means may be used to permanently mount the server power contact member 26 to the server power station 24. The server power contact member 26 is electrically connected to the beverage server 22 by a contact assembly 80, part of which is provided on the front wall 68 of the server power contact member 26 and part of which is provided on the rear wall 34 of the housing 28. The contact assembly 80 provides a conductive coupling to transmit power to the heating assembly and control circuit 50 within the housing 28 of the beverage server 22 from the server power station 24. The structure and function of the contact assembly 80 is described in co-pending application Ser. No. 09/057,463 which disclosure has been incorporated by reference herein.

To position the beverage server 22 relative to the server power station 24, a pair of opposed side guides 82 are connected to and extend upwardly from the top 58 of the server power station 24 and a front guide 84 extends upwardly from the top 58 of the server power station 24. When positioned within the area defined by the side guides 82, the front guide 84 and the server power contact member 26, the contact assembly 80 is directed into engagement between beverage server 22 and the server power contact member 26 and the front guide 84 overlaps the front wall 32 of the housing 28 and the respective side guides 82 overlap the respective side walls 36 of the housing 28.

To retain the beverage server 22 on the server power station 24 should a customer attempt to tip the top end of the beverage server 22 toward the front of the server power station 24, and thus towards the surface 86, such as a countertop 86, on which the beverage server assembly 20 is positioned, when the beverage level becomes low in an attempt to obtain further beverage from the reservoir 30, a bracket and cleat assembly 88 is provided which forms one aspect of the retaining assembly of the present invention. The bracket and cleat assembly 88 is provided to releasably couple the beverage server 22 and the server power contact member 26, and thus the server power station 24, together.

Figure 3:
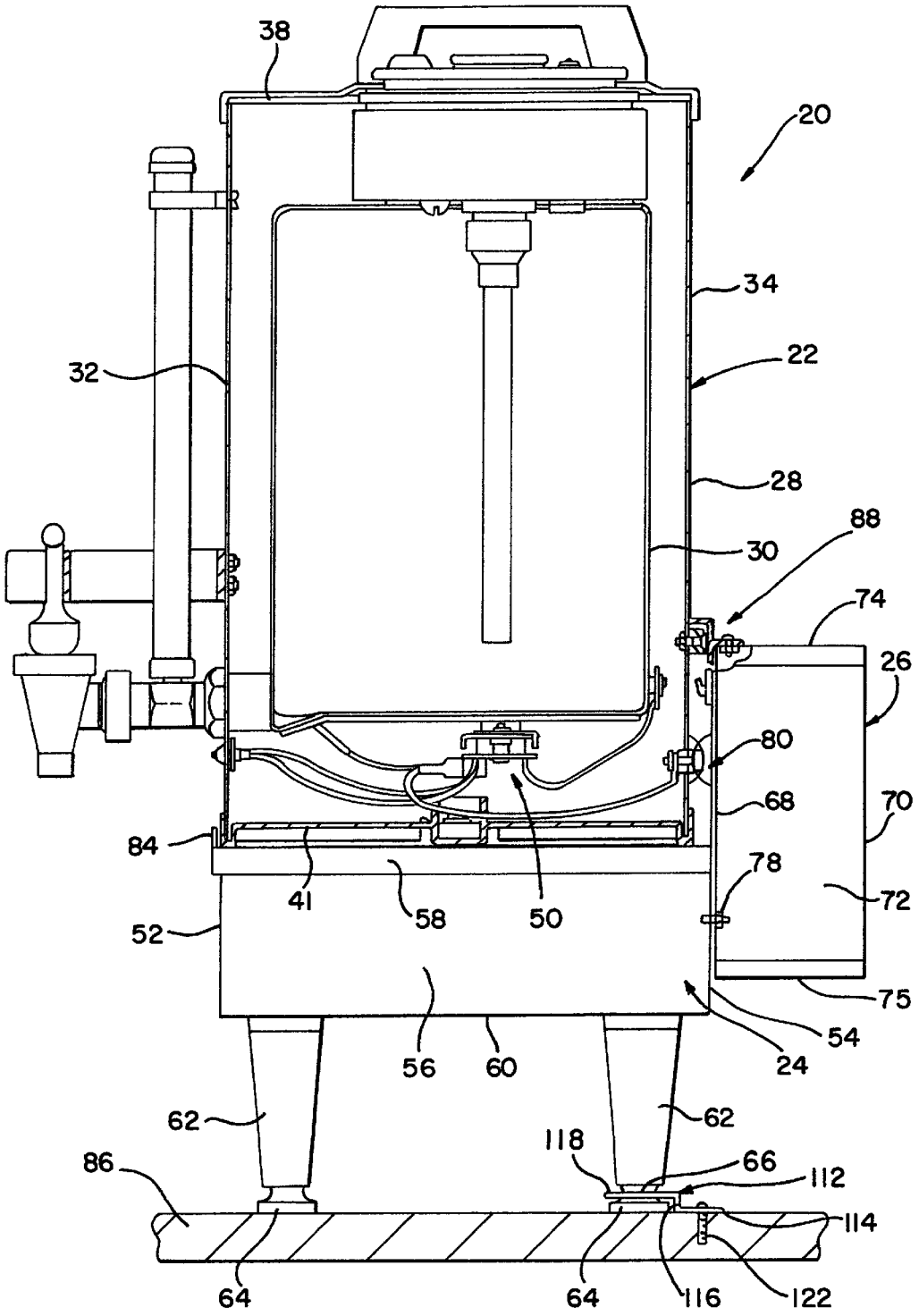
FIG. 3 is a cross-sectional view along line 3—3 of FIG. 1.
Figure 4:
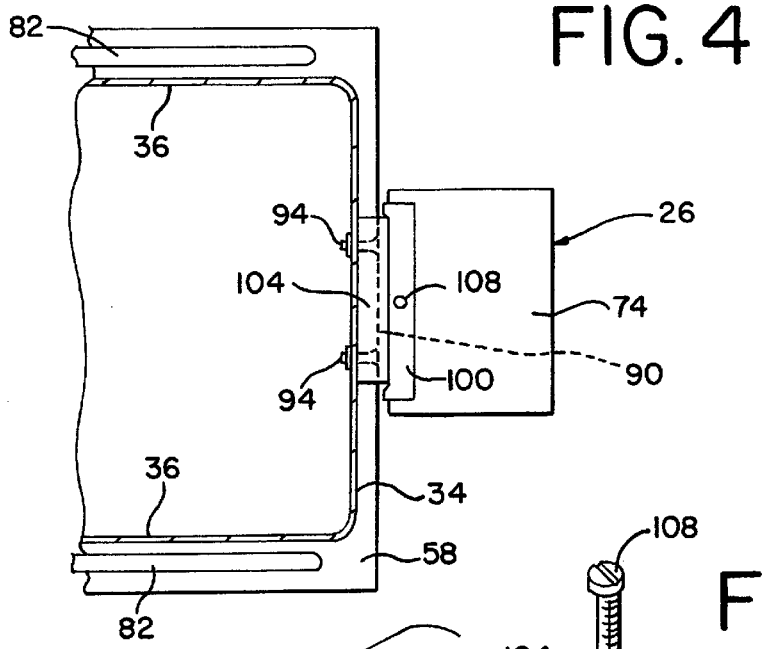
FIG. 4 is a partial cross-sectional view of the rear side of the beverage server of FIG. 1.
Figure 5:
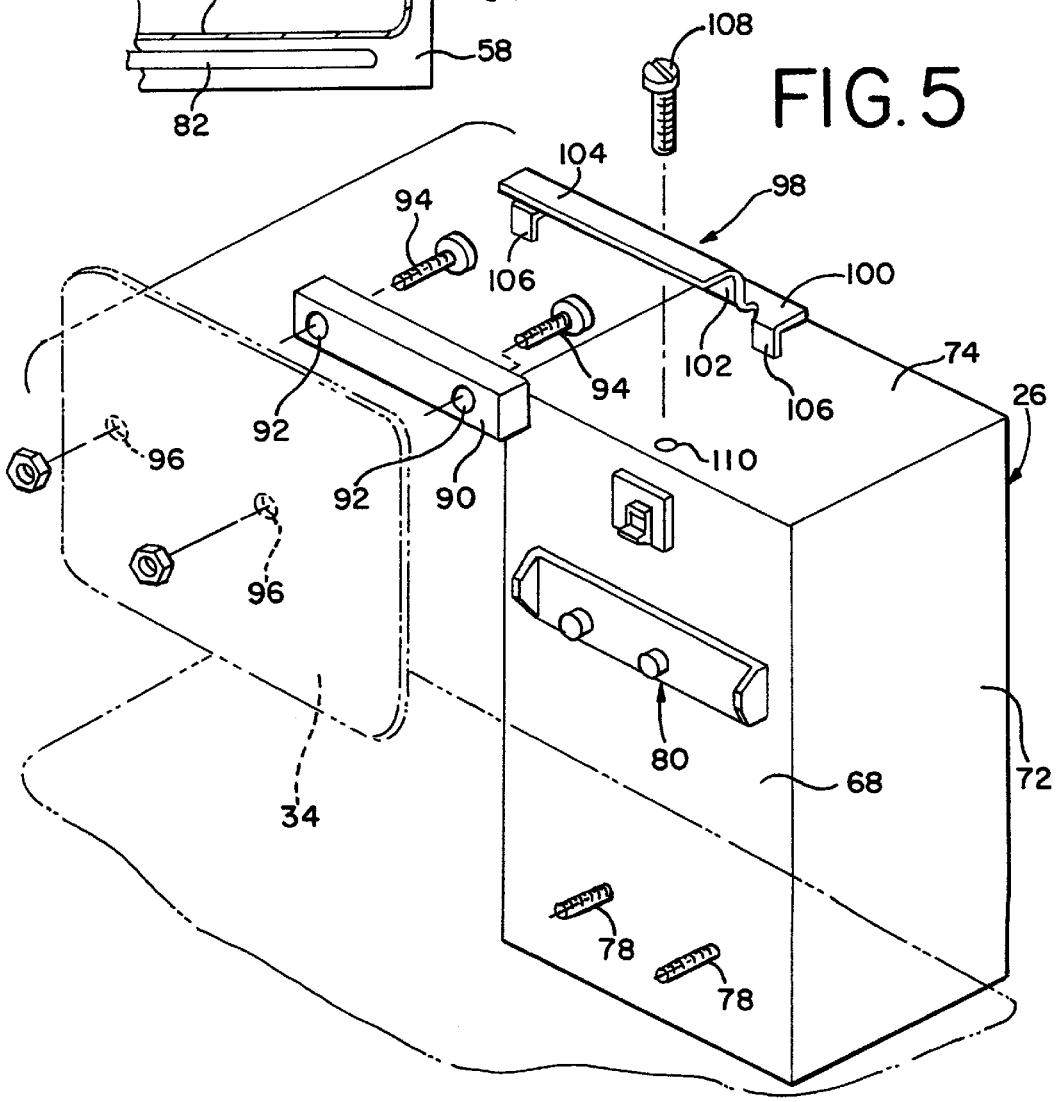
FIG. 5 is an exploded perspective view of a cleat and bracket assembly which incorporates the features of the invention provided on the rear side of the beverage server of FIG. 1.

A rectangular cleat 90 is attached to the rear wall 23 of the housing 28 at a position which is spaced a predetermined distance above the portion of the contact assembly 80 which is provided on the housing 28. The cleat 90 has a pair of spaced apart apertures 92 therethrough. Respective screws 94 are engaged through the respective apertures 92 and through apertures 96 provided in the rear wall 34 of the housing 28 which are aligned with the respective apertures 92 to mount the cleat 90 on the rear wall 34 of the housing 28. The cleat 90 is positioned on the rear wall 34 of the housing 28 in a position such that when the beverage server 22 is positioned on the server power station 24, the cleat 90 is proximate to the top wall 74 of the server power contact member 26, see FIG. 3.

A bracket 98 is provided on the server power contact member 26 and engages the cleat 90 on the housing 28 when the beverage server 22 is positioned on the server power station 24. The bracket 98 is formed from a horizontal flange 100 which bears against the top wall 74 of the server power contact member 26 and has a forward end which is aligned with the front wall 68 of the server power contact member 26 and extends rearwardly towards the rear wall 70 a predetermined distance, a generally L-shaped portion which includes a vertical leg 102 that extends upwardly from the forward end of the horizontal flange 100 and a horizontal leg 104 which extends forwardly from the upper end of the vertical leg 102, and a pair of spaced apart vertical tabs 106 attached to the forward end of the horizontal flange 100 and each of which extends downwardly therefrom and bears against the front wall 68 of the server power contact member 24. The horizontal flange 100 has an aperture therethrough. A screw 108 is engaged through the aperture and through an aligned aperture 110 provided through the top wall 74 of the server power contact member 26 to mount the bracket 98 on the server power contact member 26.

When the beverage server 22 is positioned on the server power station 24 between the pair of opposed side guides 82, the front guide 84 and the server power contact member 26, the cleat 90 is positioned such that the top wall of the cleat 90 is underneath the horizontal leg 102 of the bracket 98 and the rear wall of the cleat 90 is adjacent to the vertical leg 102 of the bracket 98. The cleat 90 does not bear snugly against the bracket 98, but the horizontal leg 104 of the bracket 98 interferes with the movement of the cleat 90 such that the top end of the beverage server 22 cannot be tipped toward the front wall 52 of the server power station 24 and the surface 86. In addition, the beverage server 22 does not sit tightly against the front guide 84, but even if the beverage server 22 is moved all of the way against the front guide 84, the horizontal leg 104 of the bracket 98 interferes with the movement of the cleat 90 in a direction which would permit a customer to tip the top end of the beverage server 22 toward the front wall 52 of the server power station 24 and the surface 86.

To remove the beverage server 22 from the server power station 24, the store person grasps the beverage server 22 by the handles 43 provided on the top 38 of the housing 28 and the handle 48 provided proximate to the faucet 44 and rotates the bottom end of the housing 28 toward himself or herself. This will release the cleat 90 from underneath the bracket 98 to enable the store person to remove the beverage server 22 from the server power station 24. The beverage server 22 can be filled and then re-inserted using a reverse motion.

It is to be understood that the cleat 90 can be provided on the front wall 68 of the server power contact member 26 and the bracket 98 can be inverted and provided on the rear wall 34 of the housing 28 to retain the beverage server 22 on the server power station 24 should the customer attempt to tip the top end of the beverage server 22 toward the front of the server power station 24, and thus towards the surface 86.

To prevent the possibility of a customer tipping the top end of the beverage server assembly 20 toward the surface 86 when the beverage level becomes low in an attempt to obtain further beverage from the reservoir 30, a pair of brackets 112, which forms the other aspect of the retaining assembly of the present invention, are provided to couple the server power station 24 to the surface 86. One bracket 112 is attached to one rear foot 64 of the server power station 24 and the other bracket 112 is attached to the other rear foot 64 of the server power station 24.

Each bracket 112 is formed from a horizontal flange 114 and an L-shaped portion which includes a vertical leg 116 that extends upwardly from the forward end of the horizontal flange 114 and a horizontal leg 118 which extends forwardly from the upper end of the vertical leg 116. The horizontal leg 116 of the L-shaped portion has an enlarged aperture 120 therethrough. To mount the bracket 112 to the foot 64, the foot 64 is removed from the leg 62, the reduced diameter portion 66 of the foot 64 is placed through the aperture 120 in the horizontal leg 116 of the bracket 112 and then the foot 64 is remounted on the leg 62. The horizontal flange 114 has an aperture therethrough. A screw 122 is engaged through the aperture and through an aligned aperture provided in the surface 86 to secure the bracket 112 to the surface 86. As a result, the server power station 24 cannot be rotated relative to the surface 86 because of the brackets 112, and thus the complete beverage server assembly 20 cannot be tipped toward the surface 86 because the server power station 24 is fixedly coupled to the server power contact member 26 and, in turn, the server power contact member 26 is coupled to the beverage server 22 by the cleat and bracket assembly 88.

It is to be understood that the leg 62 can have the reduced diameter portion 66 and the foot 64 is secured to the reduced diameter portion 66 of the leg 62. In this situation, the bracket 112 would be connected to the leg 62. In addition, it envisioned that the brackets 112 can be attached to the front feet 64 of the server power station 24 or to all four feet 64.

While a preferred embodiment of the present invention is shown and described, it is envisioned that those skilled in the art may devise various modifications of the present invention without departing from the spirit and scope of the appended claims.

The invention claimed is:

1. A beverage server assembly comprising:

a housing having a rear end and a reservoir therein for holding a beverage;

a base including a first portion and a second portion which extends upwardly from said first portion, said first portion having a front end, said second portion having a front end, said housing being capable of being seated upon said first portion with said second portion being proximate to said rear end of said housing and said housing being capable of being removed from engagement with said base;

first coupling structure extending outwardly from said rear end of said housing; and second coupling structure extending outwardly from said front end of said second portion of said base, said second coupling structure being engagable with said first coupling structure to prevent a top end of said housing from being tipped toward said front end of said first portion, said first and second coupling structures being disengagable from each other to allow said housing to be decoupled from said base, wherein one of said first coupling structure or said second coupling structure comprises a protrusion and the other of said first coupling structure or said second coupling structure comprises a bracket, said bracket overlapping said protrusion when said bracket and said protrusion are engaged; and a power transmitting assembly for transmitting power between said base and said housing, said power transmitting assembly being separate components from said first coupling structure and said second coupling structure.

2. A beverage server assembly as defined in claim 1, wherein said housing includes a front end and opposed sides and further including a front guide attached to said first portion of said base and a pair of opposed side guides attached to said first portion of said base, said front guide overlapping said front end of said housing and said respective side guides overlapping respective sides of said housing when said housing is positioned on said base.

3. A beverage server assembly as defined in claim 1, wherein said protrusion is rectangularly-shaped and said bracket is generally L-shaped.

4. A beverage server assembly as defined in claim 1, wherein said first coupling structure is substantially centered on said rear end of said housing, and said second coupling structure is substantially centered on said front end of said second portion of said base.

5. A beverage server assembly as defined in claim 1, further including structure for supporting said first portion of said base at a position spaced from a surface, and coupling structure for fixedly mounting said supporting structure to the surface.

6. A beverage server assembly comprising:

a base;

a leg attached to said base for supporting said base at a position spaced from a surface, said leg having a foot thereon;

a member for fixedly mounting said leg to the surface, said member being attached to the surface and attached to and encircling one of said foot or said leg; and a housing having a reservoir therein for holding a beverage, said housing being positioned on said base.

7. A beverage server assembly as defined in claim 6, wherein a reduced diameter portion is provided between said foot and said leg and said member is removably attached to and encircles said reduced diameter portion.

8. A beverage server assembly as defined in claim 6, wherein said base has a front end, and further including first coupling structure associated with said housing, and second coupling structure associated with said base, said second coupling structure being engagable with said first coupling structure to prevent a top end of said housing from being tipped toward said front end of said base, said first and second coupling structures being disengagable from each other to allow said housing to be decoupled from said base.

9. A beverage server assembly as defined in claims 8, wherein said first coupling structure comprises a protrusion attached to one of said housing or said base and said second coupling structure comprises a bracket attached to the other of said housing or said base.

10. A beverage server assembly as defined in claim 8, wherein said housing includes a front end and opposed sides and further including a front guide attached to said base and a pair of opposed side guides attached to said base, said front guide overlapping said front end of said housing and said respective side guides overlapping respective sides of said housing when said housing is positioned on said base.

* * * * *